US008336477B2

(12) United States Patent
Walker

(10) Patent No.: US 8,336,477 B2
(45) Date of Patent: Dec. 25, 2012

(54) WAKE SHAPING SYSTEM

(75) Inventor: Shawn M. Walker, Liberty Lake, WA (US)

(73) Assignee: Gravity Tools, LLC, Liberty Lake, WA (US)

( * ) Notice: Subject to any disclaimer, the term of this patent is extended or adjusted under 35 U.S.C. 154(b) by 93 days.

(21) Appl. No.: 12/982,875

(22) Filed: Dec. 31, 2010

(65) Prior Publication Data

US 2012/0167812 A1 Jul. 5, 2012

(51) Int. Cl.
*B63B 21/04* (2006.01)

(52) U.S. Cl. ..... 114/253; 114/125

(58) Field of Classification Search ..... 114/39.18, 114/39.23, 253, 125
See application file for complete search history.

(56) References Cited

U.S. PATENT DOCUMENTS

| | | | | |
|---|---|---|---|---|
| 545,095 | A * | 8/1895 | Redmond | 114/124 |
| 3,733,834 | A * | 5/1973 | Ludwig | 405/211 |
| 5,787,835 | A * | 8/1998 | Remnant | 114/271 |
| 5,860,384 | A | 1/1999 | Castilo | |
| 5,884,575 | A * | 3/1999 | Talasimov | 114/39.11 |
| 5,911,190 | A | 6/1999 | Lochtefeld et al. | |
| 6,105,527 | A | 8/2000 | Lochtefeld et al. | |
| 6,427,616 | B1 * | 8/2002 | Hagen | 114/125 |
| 7,029,340 | B2 | 4/2006 | Smith | |
| 7,252,047 | B1 * | 8/2007 | Baucom, Jr. | 114/284 |
| 2007/0079744 | A1 | 4/2007 | Craddock | |
| 2009/0158983 | A1 * | 6/2009 | Gale | 114/124 |

* cited by examiner

*Primary Examiner* — Stephen Avila

(57) ABSTRACT

The disclosure describes, in part, apparatuses and methods for shaping a wake of a water ski boat. Embodiments of wake shaping systems fixed to portions of a ski boat configured to heel a ski boat towards a starboard side and/or a port side of the ski boat. The wake shaping system comprising a ballast selectively positioned a distance above a waterline of a ski boat, and a distance from a pylon removeably fixed to a portion of the ski boat.

18 Claims, 10 Drawing Sheets

WAKE SHAPING SYSTEM

BACKGROUND

Ski boats and devices exist for shaping a wake for wakesurfing, wakeboarding, waterskiing, or the like. In an effort to enhance a wakesurfing experience, devices and methods have been attempted to improve the wake of a ski boat for wakesurfing or wakeboarding. For example, a method of requesting passengers to arrange them selves on an aft port portion, or an aft starboard portion, of the water ski boat to act as aft port ballast, or aft starboard ballast, in an effort to heel a ski boat to either the port side or the starboard side, is practiced by both wakesurfers and wakeboarders alike. Another method used by wakesurfers and wakeboarders alike, is to trim a sterndrive or an outboard motor of the ski boat in order to force the aft portion of the ski boat into the water, keeping the ski boat in a pitched orientation, thereby producing a larger wake. These and other methods of shaping a wake of a ski boat are effective to produce a larger wake, however these methods may be hazardous for the skier and the passengers alike.

As the sport of wakesurfing progresses, ski boat manufactures have been including wake shaping systems that shape the wake of the ski boat. For example, wake shaping devices integrated with the ski boat exist as bulky heavy bilge ballasts, trim plates, and even, internal hull wings.

While these systems are successful at shaping the wake of a ski boat for wakesurfing, there is still room for improved devices and methods for shaping a wake of a ski boat for wakesurfing.

SUMMARY OF THE PRESENT INVENTION

Wake shaping devices are well known. For example, there exist bladder ballast devices, hydrofoil devices and water funneling devices for shaping the wake of a ski boat. The wake shaping devices and methods disclosed herein generally relate to shaping a wake of a recreational ski boat for wakesurfing. More specifically, the devices and methods disclosed herein relate to devices and methods for shaping a wake of a ski boat by heeling the ski boat towards an aft starboard side or an aft port side of the ski boat. In effect, by heeling the ski boat towards an aft starboard side or port side, while navigating the ski boat, the ski boat is forced to displace more water on the side the ski boat is heeled towards than the other side the ski boat is heeled away from. By heeling the ski boat towards an aft starboard side or an aft port side for displacing more water on a starboard side or a port side the ski boat, the ski boat produces an asymmetrical wake. For example, the asymmetrical wake provides a wake that is larger, has a steeper and cleaner face, and is much more suitable for wakesurfing on the same side the ski boat is heeled towards than the side the ski boat is heeled away from.

Generally, the wake shaping devices, described herein, may be moveably attached to the ski boat and configured to adjustably locate a suspend bladder ballast a distance above the water line of the ski boat. While the illustrated embodiments of the wake shaping system may depict wake shaping systems suspending a ballast a distance past a gunwale of the ski boat, other locations are contemplated. For example, the ballast may be suspended any distance from a pylon of the wake shaping system, a distance past a longitudinal center line of a ski boat, a distance past a pivot point, or the like, suitable for heeling a ski boat. While the illustrated embodiments of the wake shaping system may depict wake shaping systems selectively positioned 90 degrees to a starboard side and/or a port side of a ski boat, any degree in 360 degrees could be realized. Further, while the illustrated embodiments of the wake shaping system may depict wake shaping systems pivotably coupled to a ski boat, the wake shaping system may not be pivotably coupled to a ski boat. For example, the wake shaping system may be configured to be coupled to a ski boat in a fixed position or on a rail mechanism. With the ski boat heeled towards an aft starboard side or an aft port side, the ski boat is configured to be navigated to force the ski boat to displace more water on the side the ski boat is heeled towards than the other side the ski boat is heeled away from for producing a larger, steeper, and cleaner wave on the side the ski boat is heeled towards.

The description above is for illustrative purposes only and is not intended to limit or describe the devices or methods described herein.

DETAILED DESCRIPTION OF THE PREFERRED EMBODIMENT

Figure 1B:
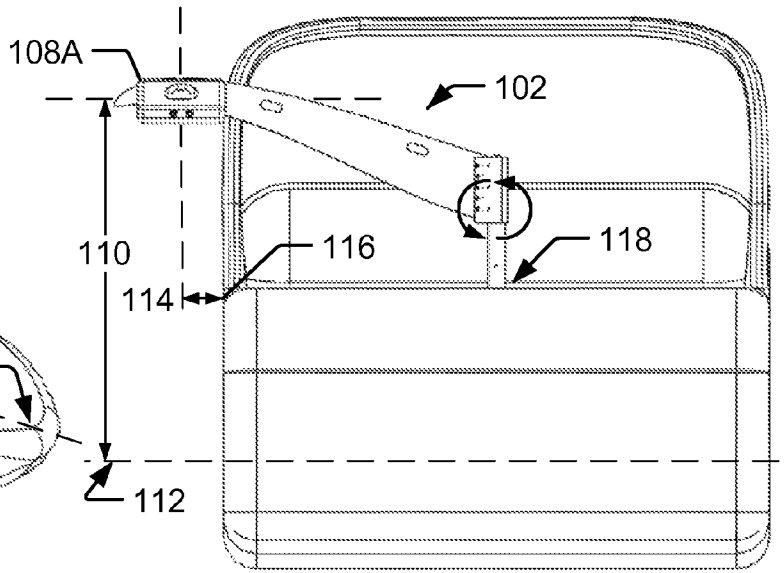
FIG. 1A and FIG. 1B illustrate a wake shaping system removeably attached to a ski boat.
Figure 1A:
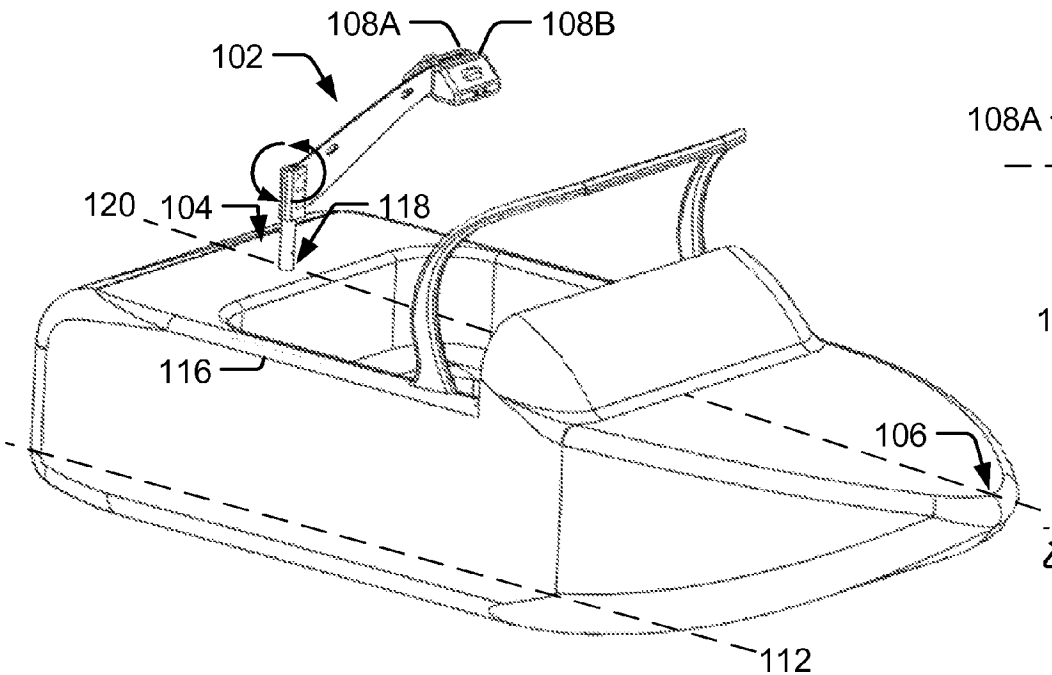

FIG. 1A and FIG. 1B illustrate a wake shaping system 102 fixed to an aft portion 104 of a ski boat 106, and a ballast 108A and 108B selectively positioned on a port side of the ski boat 106. Further, FIG. 1B illustrates the ballast 108A and 108B being selectively positioned a distance 110 above a waterline 112 of the ski boat 106, and a distance 114 past a gunwale 116 of the ski boat 106.

FIG. 1A and FIG. 1B further illustrate the wake shaping system 102 being pivotably coupled to a rope tow pylon receiver hitch 118 disposed in the aft portion 104 of the ski boat, which, in this embodiment, is substantially proximate to a longitudinal center line 120 of the ski boat 106. While FIG. 1A and FIG. 1B illustrate a wake shaping system 102 pivotably coupled to a rope tow pylon receiver hitch 118 configured to selectively position the ballast 108A and 108B on either the starboard side and/or on the port side of the ski boat 106, other methods and locations of coupling a wake shaping system to a ski boat are contemplated. For example, a wake shaping system may be fixed to an aft port gunwale corner and/or an aft starboard gunwale corner of a ski boat, a wake shaping system may be fixed to a stern (e.g., transom) portion of the ski boat, the wake shaping system may be fixed to a portion of a pylon tower of the ski boat, or the like, or any other methods and/or locations of coupling a wake shaping system to a ski boat that are capable of positioning a ballast a distance above a waterline 112 of the ski boat, and a distance past a longitudinal center line 120 of the ski boat.

Figure 2:
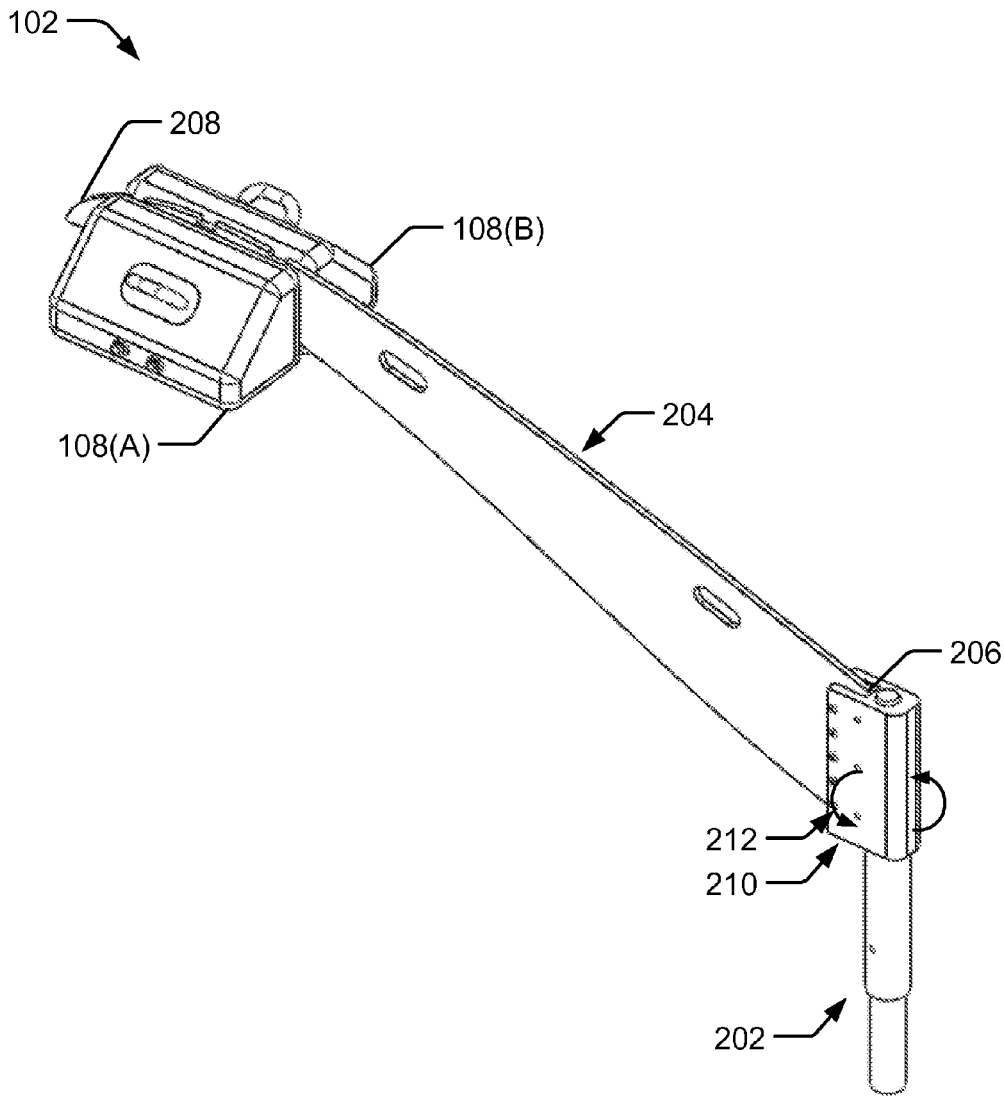
FIG. 2 illustrates the exemplary wake shaping system of FIG. 1A and FIG. 1B in more detail.

FIG. 2 illustrates the wake shaping system 102 of FIG. 1A and FIG. 1B in more detail. FIG. 2 illustrates a pylon 202 configured to be removeably fixed to the hitch 118 of the ski boat 106. Further, FIG. 2 illustrates an arm 204 having a first end 206 pivotably coupled to the pylon 202 and a second end 208 of the arm 204 configured to reach the distance 110 above the waterline 112 of the ski boat 106 and the distance 114 past the gunwale 116 of the ski boat 106. FIG. 2 further illustrates a coupling mechanism 210, for pivotably coupling the arm 204 to the pylon 202. With the first end 206 of arm 204 pivotably coupled to the pylon 202 via coupling mechanism 210, the arm 204 is configured to pivot 212 at least about 210 degrees horizontally about the pylon 202 for selectively positioning the ballast past the port gunwale, the stern gunwale, or the starboard gunwale of the ski boat 106. Further, with the ballast 108A and 108B being removeably coupled to the second end 208 of the arm 204, the ballast 108A and 108B is configured to be selectively positioned the distance 110 above the waterline 112 of the ski boat 106.

Figure 3:
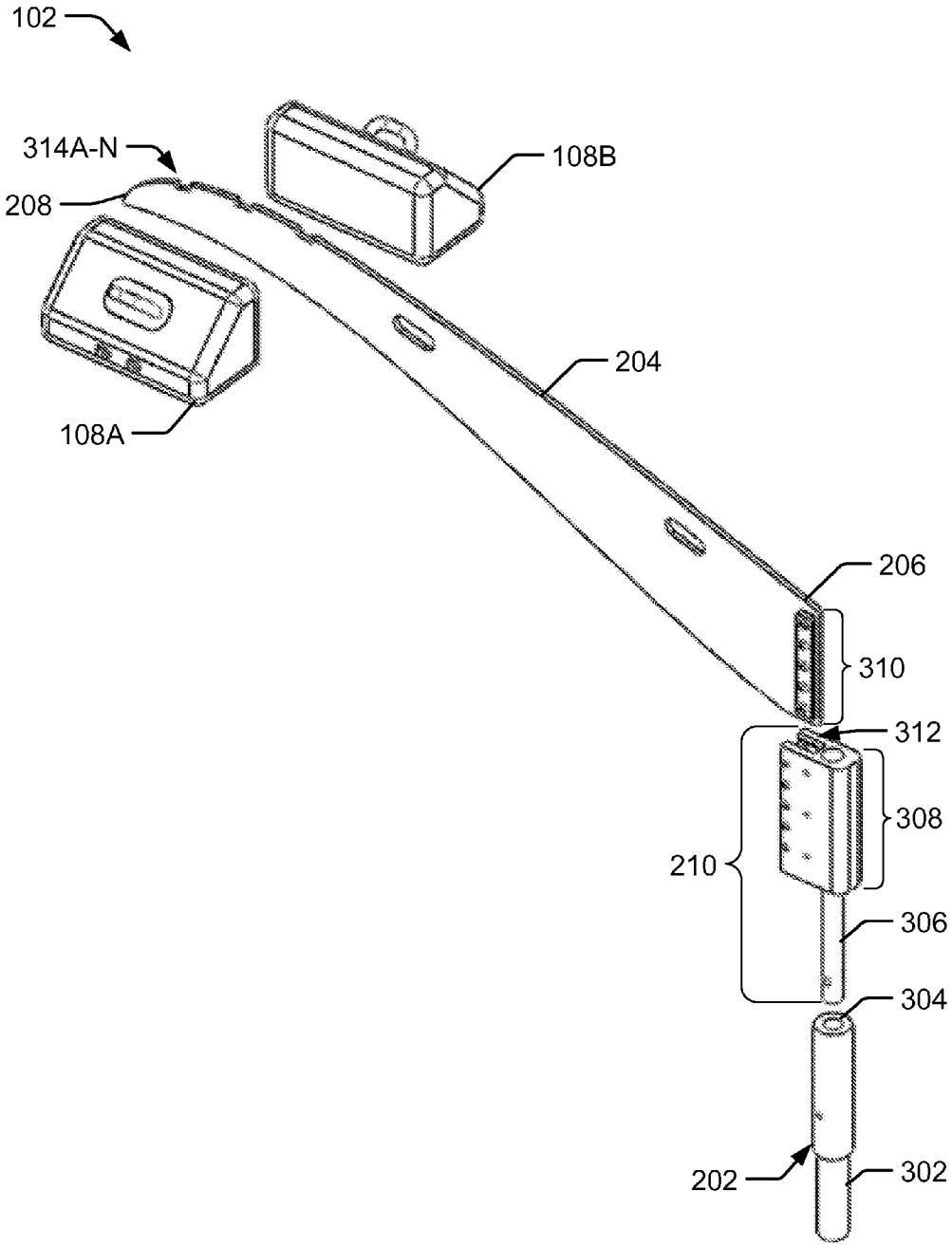
FIG. 3 illustrates the wake shaping system of FIG. 2 in more detail in an exploded view.

FIG. 3 illustrates the wake shaping system 102 of FIG. 2 in more detail in an exploded view. FIG. 3 shows the pylon 202 comprising a pin 302 configured to be received by the receiver hitch 118 disposed in the aft portion 104 of the ski boat 106, and an opening 304 configured to receive a pin 306 extending distally from a bearing portion 308 of the coupling mechanism 210. FIG. 3 further illustrates a male clamping portion 310 disposed on the first end 206 of the arm 204 configured to be removeably clamped to a female clamping portion 312. Female clamping portion 312 is illustrated as being juxtaposed to the bearing portion 308. FIG. 3 also illustrates a group of notches 314A-N arranged proximate to the first end 206 of the arm 204 configured for removeably coupling the ballast 108A and 108B to the arm 204 a distance 114 past the gunwale 116 of the ski boat 106. While a group of notches 314A-N are illustrated as being arranged proximate to the first end 206 of the arm 204, other attachment mechanism for removeably coupling the ballast 108A and 108B to the arm 204 are contemplated. For example a sliding latch mechanism (e.g., a track and latch) arranged from the first end 206 of the arm 204 to the second end 208 of the arm 204 is also contemplated. The sliding mechanism being configured to selectively slide the ballast 108A and 108B between the first end 206 and the second end 208. Further, the sliding latch mechanism may be a spring loaded mechanism, configured to slideably push the ballast 108A and 108B from the first end 206 of the arm 204 to the second end 208 of the arm on a track. Further, while multiple slideable embodiments removeably coupling the ballast 108A and 108B to the arm 204 proximate to the second end 208 of the arm 204 have been described, any other removeable coupling mechanisms suitable for selectively positioning the ballast 108A and 108B a distance 114 past the gunwale 116 of the ski boat 106 are contemplated. For example, the ballast 108A and 108B may be pivotably position from the first end 206 proximate to the second end 208 of the arm 204, or the arm 204 may be slideably attached to the pylon 202 for slideably displacing the arm 204, such that the ballast 108A and 108B is positioned the distance 114 past the gunwale 116 of the ski boat 106.

FIG. 3 further illustrates the ballast 108A and 108B being configured to be removeably disposed proximate to the first end 206 of the arm 204. Here, in this configuration illustrated in FIG. 3, the ballast 108A and 108B comprises separate collapsible containers configured to contain approximately about 2 gallons of water, respectively. While the ballast 108A and 108B are illustrated as two separate collapsible containers, other configurations are contemplated. For example, the ballast 108A and 108B may be a single collapsible container formed of flexible light weight material (e.g., plastic, rubber, fabric, or the like). Further, the ballast 108A and 108B may be configured to be quickly and easily filled with water, and also quickly and easily evacuated of water. For example, ballast 108A and 108B may be easily filled with water from a body of water (e.g., a lake, a reservoir, an ocean, or the like) that the ski boat may be launched in, by simply submerging the ballast 108A and 108B in the body of water and allowing the water to fill the ballast 108A and 108B. Likewise, the ballast 108A and 108B may be easily emptied by simply evacuating the water contained in the ballast back into the body of water. In the embodiment, described above, where the ballast 108A and 108B may comprise a single bladder formed of a flexible light weight material suitable for containing water, the single bladder may be interconnected with a pump aboard the ski boat 106 and filled and/or drained via the pump aboard the ski boat 106. Further, the single bladder may be filled via the pump aboard the ski boat 106 and drained via a drain feature. For example, the single bladder may comprise a drain plug, a drain zipper, a drain flap, a drain valve, or the like, suitable for evacuating a bladder suspended a distance above a waterline of a ski boat, and a distance past a gunwale of the ski boat. Further, while the ballast 108A and 108B, illustrated in FIG. 3, has been described as comprising a water ballast, other ballasts are contemplated. For example, a ballast may be a metal weight, multiple metal weights, or the like, suitable for being suspended a distance above a waterline of a ski boat and a distance past a gunwale of the ski boat.

Figure 4:
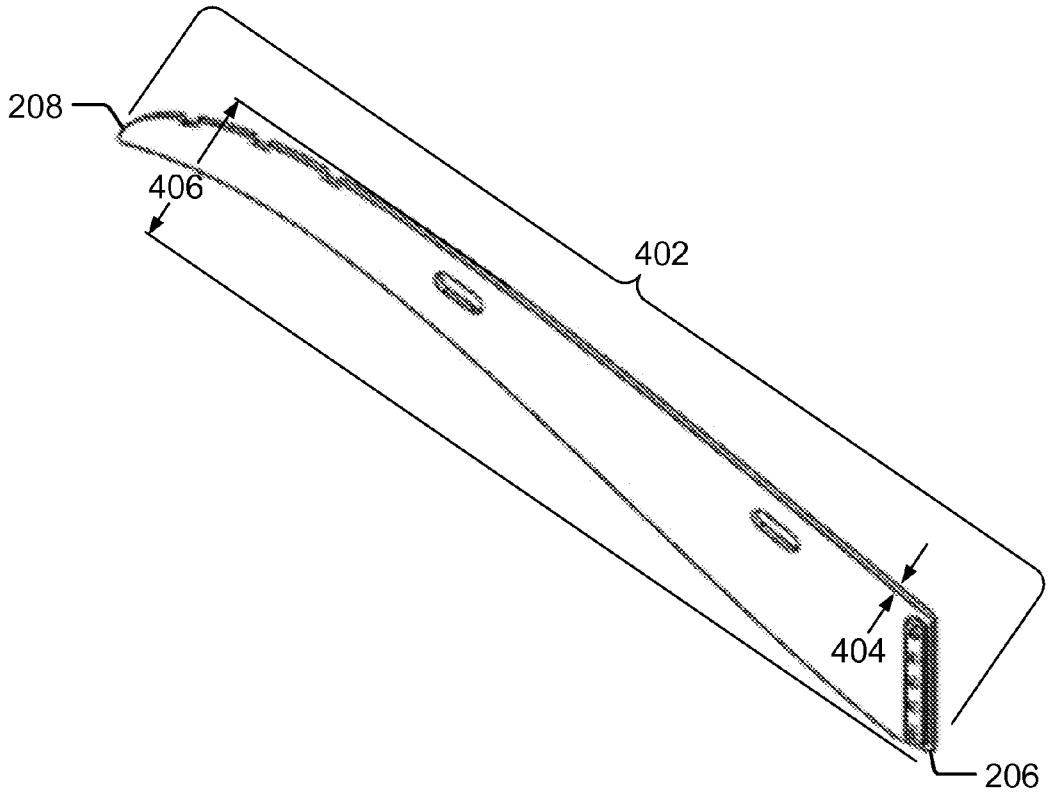
FIG. 4 illustrates in more detail, the arm illustrated in FIG. 2.

FIG. 4, illustrates in more detail, arm 204 illustrated in FIG. 2. As discussed above, and as illustrated in FIG. 4 the arm 204 comprises a first end 206 configured to couple to a pylon 202 and a second end 208 of the arm 204 configured to reach the distance 110 above the waterline 112 of the ski boat 106 and the distance 114 past the gunwale 116 of the ski boat 106. Here, FIG. 4 illustrates the arm 204 formed of a plate material (e.g., aluminum, steel, carbon fiber, or the like) comprising a length 402 of approximately about 72 inches, a width 404 of approximately about 0.5 inches, and an overall depth 406 of approximately about 18 inches. While FIG. 4 illustrates a generally curvilinear-shaped arm formed of a plate material, other shapes and/or materials are contemplated. For example, an arm may be generally curvilinear-shaped and formed of fiberglass, plastic, metal tubes, or the like, suitable for suspending a ballast the distance 114 past the gunwale 116 of the ski boat 106 and the distance 110 above the waterline of the ski boat 106. Further, while FIG. 4 illustrates a generally curvilinear-shaped arm that is a single blade of material, the generally curvilinear-shaped arm may be multiple curvilinear-shaped arms forming a fan shaped assembly. Further, the curvilinear-shaped arm may also be a generally hollow curvilinear-shaped arm that has a width substantially larger than width 404. Here, in this configuration, the generally hollow curvilinear-shaped arm may be configured to house an internal reservoir proximate to the second end 208 of the arm 204. Further, while FIG. 4 illustrates an arm 204 having a length 402 of approximately 72 inches, other lengths are contemplated. For example an arm may be any length shorter or longer than 72 inches. Specifically, when the wake shaping system 102 is configured to be mounted in any of the other methods and/or locations, described above, for coupling a wake shaping system to a ski boat that are capable of positioning a ballast a distance above a waterline of the ski boat, and a distance past a gunwale of the ski boat, an arm may be any length shorter or longer than 72 inches. For example, when a wake shaping system is configured to be fixed to either an aft port gunwale corner and/or an aft starboard gunwale corner of a ski boat, the arm may be shorter than 72 inches. Further, in the embodiment, where a wake shaping system is configured to be fixed to a stern portion of a ski boat, the arm may be shorter than 72 inches. Further, in the embodiment, where a wake shaping system is configured to be fixed to a portion of a pylon tower of a ski boat, the arm may be shorter or longer than 72 inches.

Figure 5:
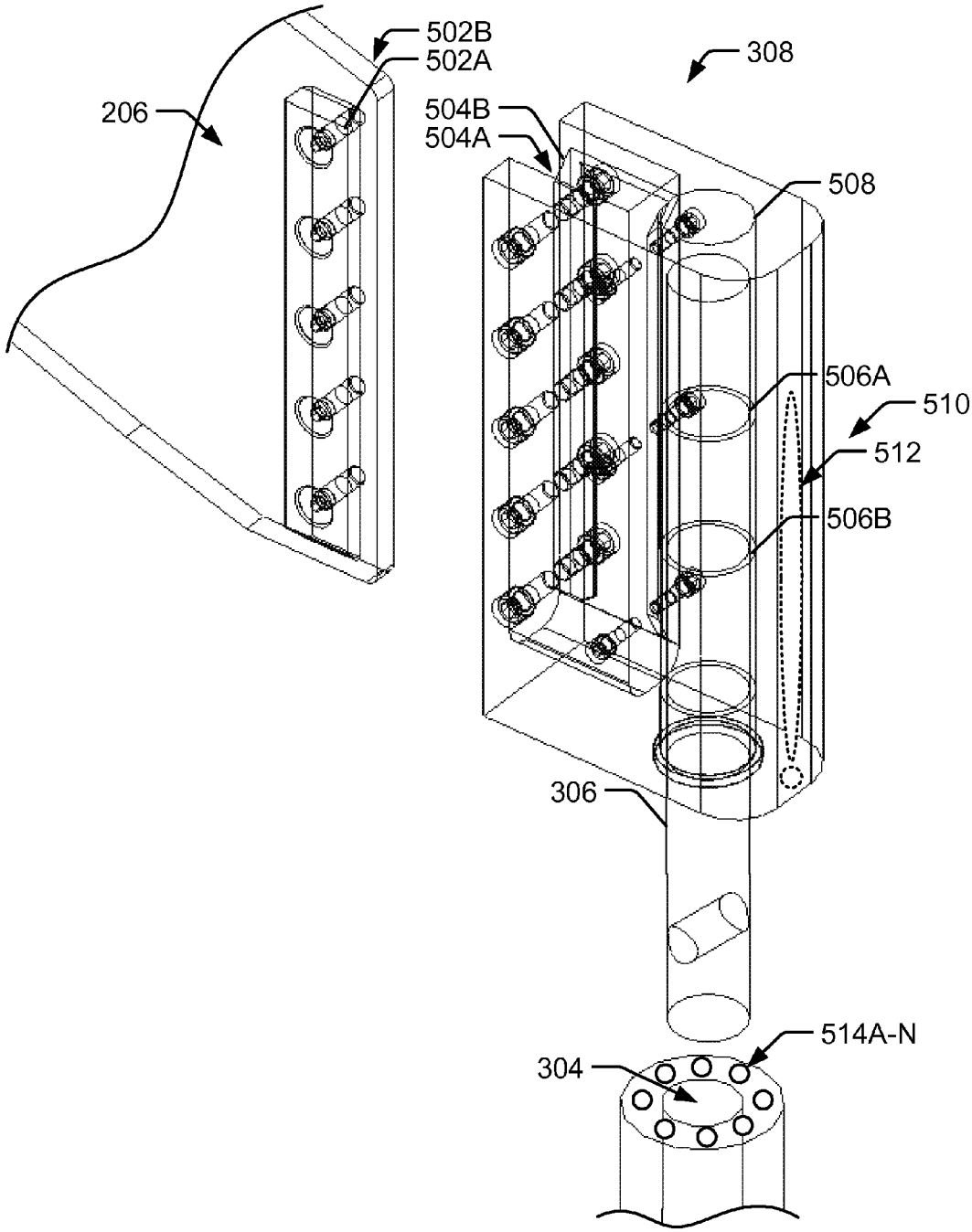
FIG. 5 illustrates an enlarged exploded view of the coupling mechanism of FIG. 2.

FIG. 5 illustrates an enlarged exploded view of the coupling mechanism 210 of FIG. 2. Specifically, FIG. 5 illustrates an enlarged exploded view of the male clamping portion 310 disposed on the first end 206 of the arm 204 configured to be removeably clamped to the female clamping portion 312 juxtaposed to the bearing portion 308 in more detail. In addition, FIG. 5 also illustrates the bearing portion 308 in more detail.

FIG. 5 illustrates the male clamping portion 310 disposed on the first end 206 of the arm 204 comprising a symmetric pair of wedge-shaped bodies 502A and 502B. Here, the wedge-shaped bodies 502A and 502B are formed of metal and are fastened to both sides of the first end 206 of the arm 204 via threaded fasteners. Similarly, the female clamping portion 312 juxtaposed to the bearing portion 308 is illustrated in FIG. 5 as comprising another pair of symmetric wedge-shaped bodies 504A and 504B. Again, here, the wedge-shaped bodies 504A and 504B are formed of metal and are fastened to a portion of the coupling mechanism 210 juxtaposed to the bearing portion 308. With the wedge-shaped bodies 502A and 502B, and 504A and 504B fastened to the first end 206 of the arm 204, and fastened to the coupling mechanism 210, respectively, the wedge-shaped bodies 502A and 502B, and 504A and 504B define a dovetail fastening assembly configured to removeably couple the arm 204 to the coupling mechanism 210. While FIG. 5 illustrates a dovetail fastening assembly, other fastening assemblies are contemplated. For example, the arm 204 may be fastened to the coupling mechanism via a pin(s) connection, a threaded fastener(s) connection, a weld(s), or the like, suitable for suspending a ballast a distance above a waterline of the ski boat, and a distance past a gunwale of the ski boat. Further, while FIG. 5 illustrate wedge-shaped bodies 502A and 502B, and 504A and 504B fastened to the first end 206 of the arm 204, and fastened to the coupling mechanism 210, respectively, via threaded fasteners, other fastening mechanisms are contemplated. For example, the wedge-shaped bodies 502A and 502B, and 504A and 504B may be fastened to the arm 204, and to the coupling mechanism 210, respectively, via a weld, adhesive, or the like. Further, the wedge-shaped bodies 502A and 502B, and 504A and 504B may be formed of the same pieces of materials, defining single units. For example, the wedge-shaped bodies 502A and 502B may be machined in the first end 206 of the arm 204 formed of a single material, defining a single body. Similarly, the wedge-shaped bodies 504A and 504B may be machined in the portion juxtaposed to the bearing portion 308 of the coupling mechanism 210 formed of a single material, defining another single body.

FIG. 5 further illustrates the coupling mechanism 210 comprising a pair of bearings 506A and 506B disposed in a cylinder 508 of the bearing portion 308 of the coupling mechanism 210. Here, in this embodiment, the bearings 506A and 506B are for pivoting the arm 204 about pin 306. While FIG. 5 illustrates two rolling-element bearings 506A and 506B disposed in the cylinder 508, other bearing types and quantities are contemplated. For example, the coupling mechanism 210 may comprise a single rolling-element bearing arranged along the length of the cylinder wall 508. Alternatively, the bearings 506A and 506B disposed in the cylinder 508 may be a plain bearing formed of plastic (e.g., nylon). Further, bearings 506A and 506B may be augmented or replaced with a gear mechanism configured to rotate the arm 204 about pin 306. For example, the wake shaping system may include a manual gear mechanism, an electric gear mechanism, a hydraulic gear mechanism, or the like, suitable for pivoting an arm 204 about a pivot.

Here, in this embodiment, FIG. 5 illustrates a locking mechanism 510 comprising a slideable pin 512 configured to be received by any one of an indexed aperture of an array of indexed apertures 416A-N. FIG. 5 illustrates the slideable pin 512 being disposed in the bearing portion 308 of the coupling mechanism 210 and configured to mate with the array of indexed apertures 416A-N arranged around the perimeter of the opening 304 of pylon 202. With the locking mechanism 510 comprising a slideable pin 512 configured to be received by any one the array of indexed apertures 416A-N, the wake shaping system 102 is configured to locked into a desired position (e.g., towards the port side, towards the starboard side, or towards the stern). While FIG. 5 illustrates a locking mechanism 510 comprising a slideable pin 512 configured to be received by any one of an array of indexed apertures 514A-N, other locking mechanisms are contemplated. For example, the locking mechanism may comprise multiple slideable pins configured to be received by indexed apertures. Further, the locking mechanism may not comprise a slideable pin and instead may be a clamping mechanism (e.g., a clutch), interlocking male and female indexed notches, or the like, suitable for locking an arm suspending a ballast a distance above a waterline of a ski boat and a distance past a gunwale of a ski boat into a use's desired position. Further, a safety un-locking mechanism is also contemplated. For example, pin 512 may comprise a notched area configured to allow the pin 512 to break at an indexed aperture 514A-N releasing the arm 204 for allowing the arm 204 to freely pivot about the pylon 202.

Alternative Embodiments of Wake Shaping Systems

Figure 6:
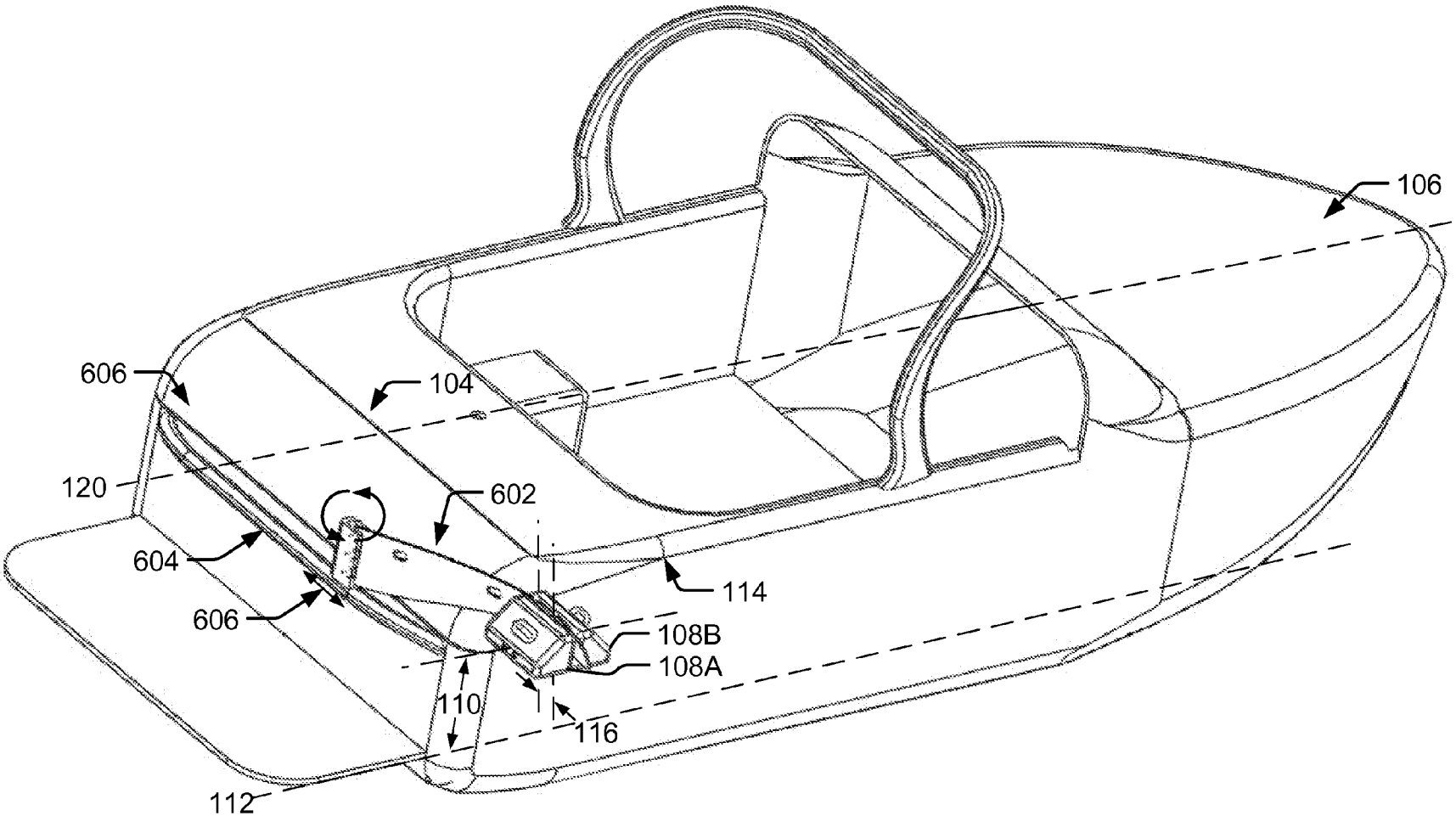
FIG. 6 and FIG. 7 illustrate two embodiments of wake shaping systems fixed to substantially aft portions of a ski boat.

FIG. 6 illustrates a wake shaping system 602 fixed to a substantially aft portion 104 of a ski boat 106. Here, in this illustrated embodiment, the wake shaping system 602 comprises a rail mechanism 604 disposed on a stern portion 606 of ski boat 106, and arranged between the starboard side and the port side. FIG. 6 further illustrates the rail mechanism 604 being configured to selectively position the wake shaping system 602 on the starboard side and/or on the port side of the ski boat 106. For example, here in this embodiment, the wake shaping system 602 may be selectively positioned anywhere along the rail mechanism 604. Specifically, wake shaping system 602 may be slideable 606 to the port side or the starboard side of ski boat 106. Here, FIG. 6 illustrates the wake shaping system 602 selectively positioned on the starboard side of ski boat 106. With the wake shaping system 602 selectively positioned on the starboard side of ski boat 106, FIG. 6 illustrates the ballast 108A and 108B being selectively positioned a distance 110 above a waterline 112 of the ski boat 106, and a distance 114 past a gunwale 116 for heeling ski boat 106.

While FIG. 6 illustrates a rail mechanism 604 disposed on an outside (i.e., waterside) surface of the hull (e.g., a transom) of the ski boat 106, other locations are contemplated. For example, the rail mechanism 604 may be disposed internal (i.e., deck side) to the hull, and configured to couple to the wake shaping system 602 arranged on the outside surface of the hull.

Figure 7:
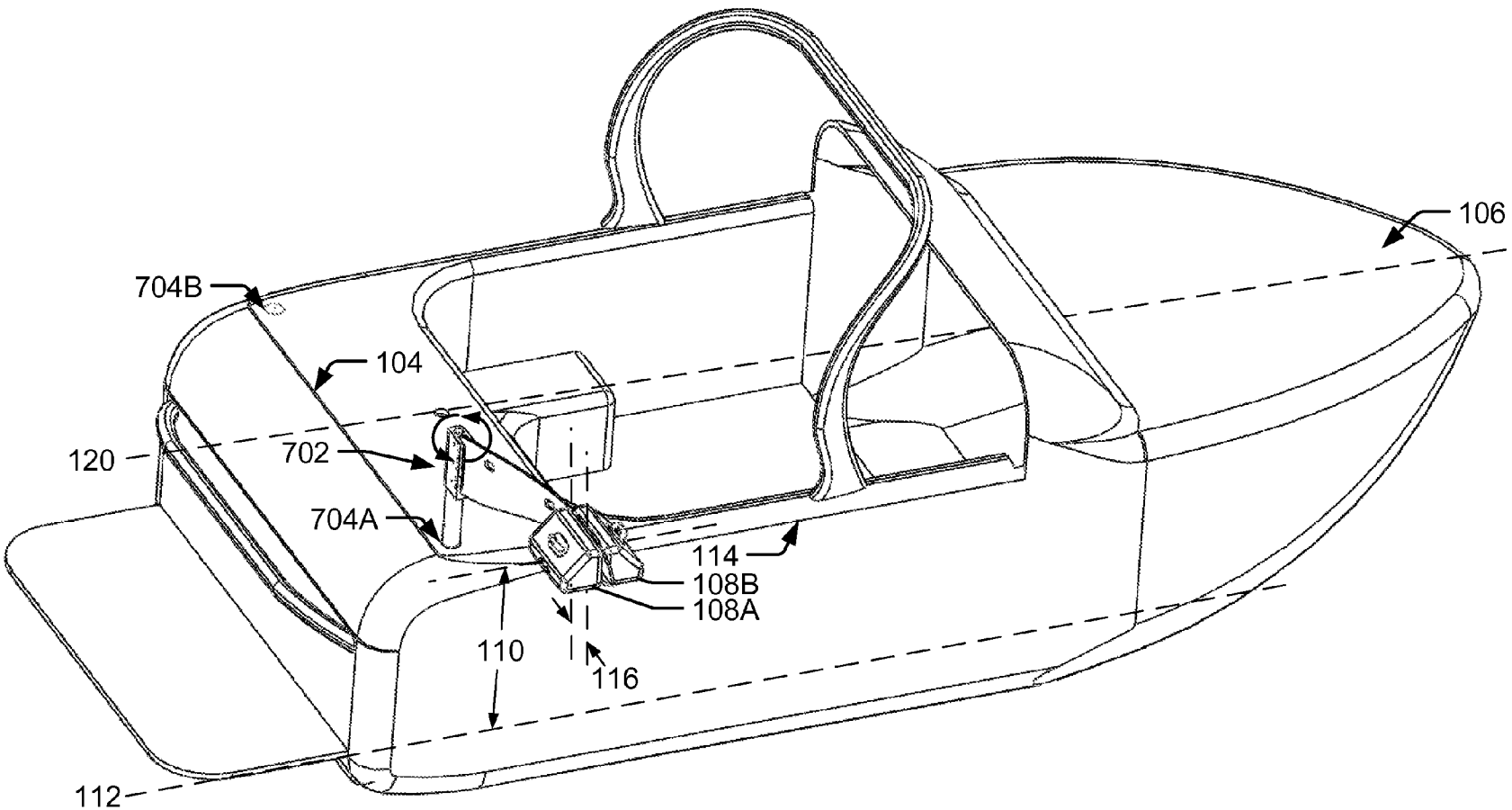

FIG. 7 illustrates a wake shaping system 702 fixed to a substantially aft portion of a ski boat 106. Here, in this illustrated embodiment, the wake shaping system 702 is pivotably coupled substantially proximate to a stern starboard gunwale corner 704A of ski boat 106. While FIG. 7 illustrates the wake shaping system 702 pivotably coupled substantially proximate to the stern starboard gunwale corner 704A, the wake shaping system 702 may be pivotably coupled substantially proximate to the stern port gunwale corner 704A. Further, while FIG. 7 illustrates a single wake shaping system 702 pivotably coupled substantially proximate to the stern starboard gunwale corner 704A, another additional wake shaping system may also be included. For example, the other additional wake shaping system may be pivotably coupled substantially proximate to a stern port gunwale corner 704B. While, FIG. 7 illustrates the wake shaping system 702 protruding from a top surface 708 of the stern starboard gunwale corner 704A other locations are contemplated. For example, the wake shaping system 702 may protrude from either an outside (i.e., waterside) or inside (i.e., deck side) surface of the stern starboard gunwale corner, and the stern port gunwale corner, respectively. More specifically, it is contemplated that the wake shaping system 702 may be pivotably coupled and protrude from rope tow pylon receiver hitches disposed in both stern starboard, and stern port, gunwale corners of ski boat 106.

With the wake shaping system 702 pivotably coupled substantially proximate to the stern starboard gunwale corner 704A, the wake shaping system 702, is configured to be selectively positioned toward the starboard side of ski boat 106. FIG. 7 illustrates wake shaping system 702 selectively positioned toward the starboard side and the ballast 108A and 108B being selectively positioned a distance 110 above a waterline 112 of the ski boat 106, and a distance 114 past a gunwale 116 for heeling ski boat 106.

Figure 8:
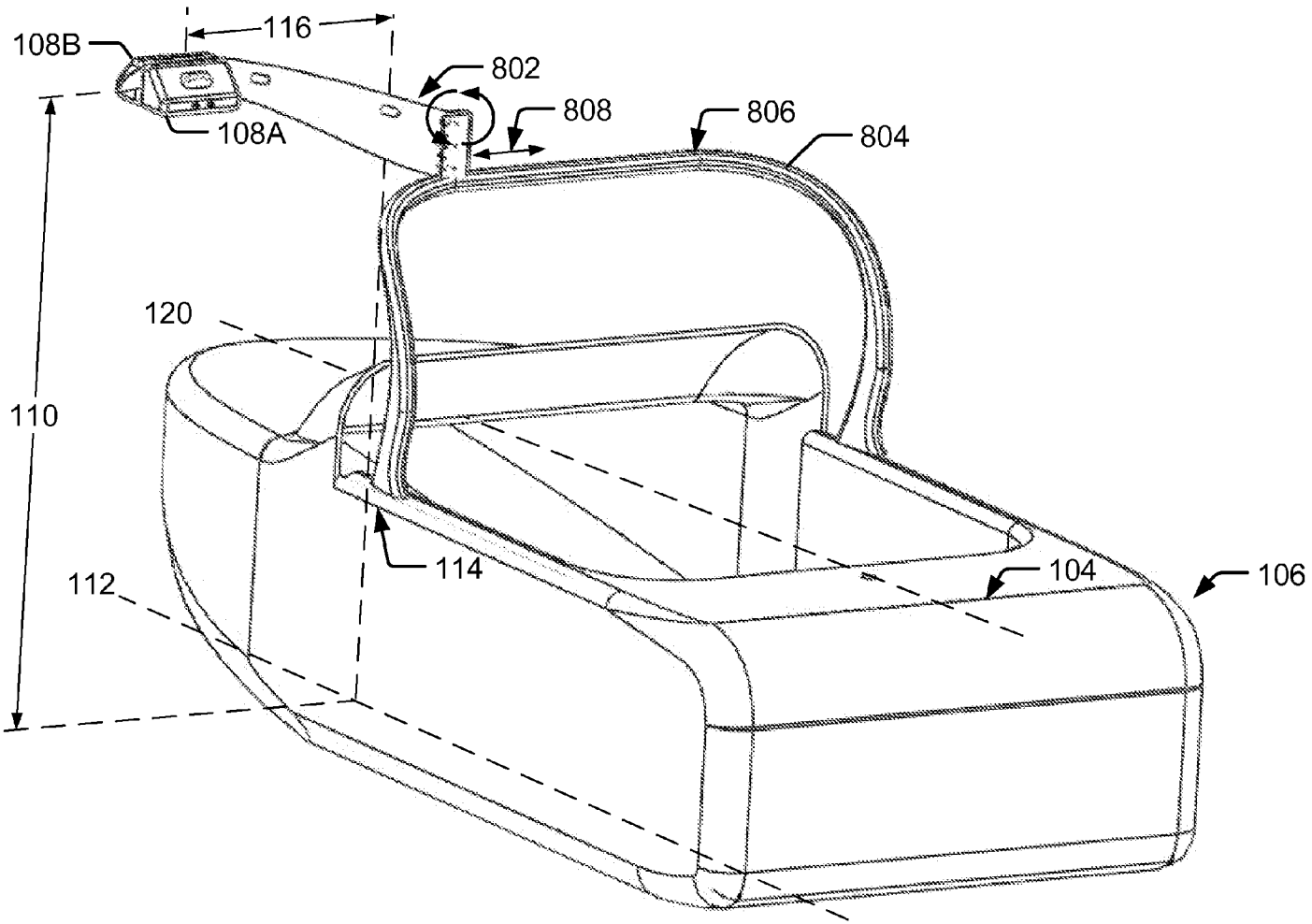
FIG. 8 illustrates a wake shaping system fixed to a portion of a pylon tower of a ski boat.

FIG. 8 illustrates a wake shaping system 802 fixed to a portion of a pylon tower 804 of ski boat 106. Here, in this embodiment, the portion of the pylon tower 804 is configured to selectively position the wake shaping system 802 to the port side of the ski boat 106. Further, in this illustrated embodiment, the wake shaping system 802 is pivotably coupled substantially proximate to a port side of the pylon tower 804. While FIG. 8 illustrates the wake shaping system 802 pivotably coupled substantially proximate to a port side of the pylon tower 804, the wake shaping system 802 may be pivotably coupled substantially proximate to the starboard side of the pylon tower 804. Further, the wake shaping system 802 may be pivotably coupled to a rail mechanism 806 arranged on a top portion of the pylon tower 804, the rail mechanism 806 being configured to selectively slide 808 the wake shaping system 802 to the starboard side and/or the port side of the ski boat 106.

With the wake shaping system 802 pivotably coupled substantially proximate to the starboard side of the pylon tower 804, the wake shaping system 802, is configured to be selectively positioned toward the starboard side of ski boat 106. FIG. 8 illustrates wake shaping system 802 selectively positioned toward the starboard side and the ballast 108A and 108B being selectively positioned a distance 110 above a waterline 112 of the ski boat 106, and a distance 114 past a gunwale 116 for heeling ski boat 106.

Detailed Description of Shaping a Wake by Heeling a Ski Boat

Figure 9:
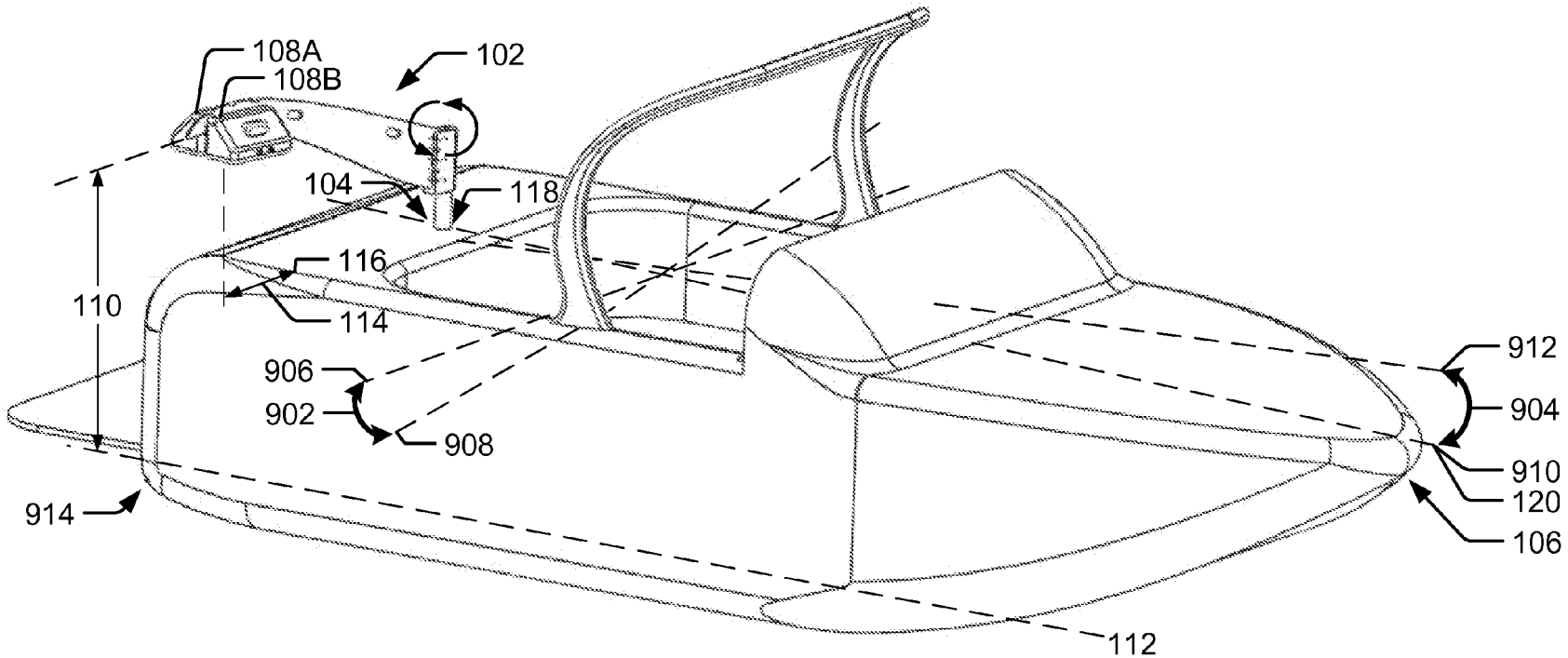
FIG. 9 illustrates a perspective view as seen from the front starboard side of the ski boat illustrated in FIG. 1, the perspective view illustrating heeling the ski boat.

FIG. 9 illustrates a perspective view as seen from the front starboard side of the ski boat 106 illustrated in FIG. 1, the perspective view illustrating a wake shaping system 102 heeling the ski boat 106 towards the starboard side. Here, in this embodiment, FIG. 9 illustrates the wake shaping system 102 fixed to an aft portion 104 (i.e., a rope tow pylon receiver hitch 118) of the ski boat 106. While FIG. 9 illustrates a wake shaping system 102 fixed to a rope tow pylon receiver hitch 118 disposed substantially proximate to the longitudinal center line 120 of the ski boat 106, any of the previously described wake shaping system embodiments could be illustrated here in FIG. 9. For example, FIG. 9 could alternatively illustrate the embodiment of the wake shaping system illustrated in FIG. 6 (i.e., a wake shaping system coupled to a rail mechanism disposed on a stern portion of ski boat), FIG. 7 (i.e., a wake shaping system fixed to an aft starboard gunwale corner of a ski boat), FIG. 8 (i.e., a wake shaping system fixed to a portion of a pylon tower of ski boat). Further, FIG. 9 could alternatively illustrate any other wake shaping system that is configured to positioning a ballast a distance above a waterline, and a distance past a gunwale on the starboard side of ski boat.

Here, FIG. 9 illustrates the wake shaping system 102 positioning a ballast 108A and 108B a distance 110 above a waterline 112, and a distance 114 past a gunwale 116 on the starboard side of ski boat 106. With the ballast 108A and 108B positioned the distance 110 above the waterline 112, and the distance 114 past the gunwale 116 on the starboard side of ski boat 106, the ski boat is forced to heel towards the starboard side. Here, as FIG. 9 illustrates, by positioning the wake shaping system 102 on the starboard side, the heeling of ski boat 106 comprises rolling the ski boat 106, a degree 902, towards the starboard side, along with pitching the ski boat, another degree 904, towards the stern. Specifically, FIG. 9 illustrates rolling the ski boat 106 a degree 902 from a neutral latitudinal axis 906 to a rolled axis 908, and pitching the ski boat 106 the other degree 904 from a neutral longitudinal axis 910 to a pitched axis 912. While FIG. 9 illustrates a rolling a ski boat a degree 902 towards the starboard side, along with pitching the ski boat another degree 904 towards the stern, additional forces may be added to the heeling of the ski boat. For example, other wake enhancing devices, such as, a ballast (e.g., Fatsac™ by Barefoot International Milwaukee Wis.) disposed in a hull of a boat, a hydrofoil (e.g., Power Wedge® by Malibu Boats in Merced Calif.), or the like, capable of enhancing a wake of a ski boat 106 may be used along with a wake shaping wake shaping system configured to adjustably locate a suspend bladder ballast a distance above the water line and a distance past a gunwale of a ski boat.

FIG. 9 further illustrates an aft starboard hull corner 914 being substantially curvilinear shaped. While FIG. 9 illustrates an aft starboard hull corner 914 being substantially curvilinear shaped (i.e., convex shaped), other shapes are contemplated. For example, a ski boat 106 configured with a wake shaping system 102 may comprise a hull that is shaped to further enhance the effect of heeling a ski boat towards an aft starboard side and/or an aft port side. For example, the aft starboard hull corner and aft port side corner may comprise a wedge shape, a concave shape, a fin shape, a bulb shape, or the like, suitable for further enhancing the effect of heeling the ski boat towards the aft starboard side and/or the aft port side.

Example Processes of Shaping a Wake Using a Wake Shaping System

Figure 10:
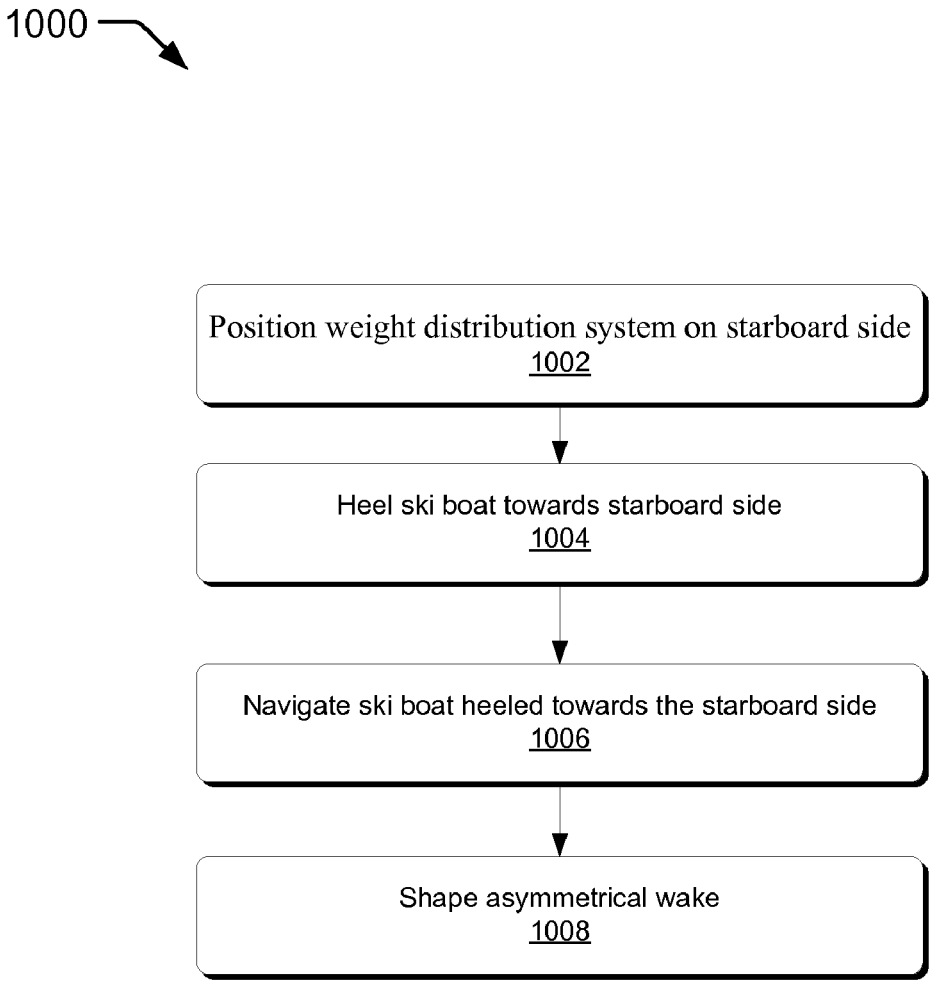
FIG. 10 illustrates an example process for shaping a wake of a water ski boat using a wake shaping system.

FIG. 10 illustrates an example process 1000 for shaping a wake of a water ski boat using a wake shaping system based at least in part on a skier skiing behind a ski boat, (e.g., wakesurfing, wakeboarding, trick skiing, barefooting, or the like) as well as on the preferred stance of the skier (e.g., standing regular or goofy footed). This process may also be further based on at least in part on other devices of the ski boat for shaping a wake of the ski boat (e.g., bilge ballast, a hydrofoil, or the like for enhancing a ski boat wake). For instance, a user (e.g., a navigator) of the ski boat may perform this process for a regular footed (i.e., a left foot in front of a back foot on a board) wakesurfer. In some instances, the user may perform this process in a body of water (e.g., a reservoir, a pond, a lake, a bay, a river, an inlet, an ocean, or the like, suitable for pulling a skier) and just prior to pulling the skier and navigating the ski boat. While FIG. 10 illustrates a process 1000 for shaping a wake of a ski boat using a wake shaping system based at least in part on a skier skiing behind a ski boat, it is to be appreciated that this process may apply to shaping a wake of any type of boat using a wake shaping system of any type of skiing (e.g., wakesurfing, wakeboarding, trick skiing, barefooting, etc.).

Process 1000 includes an operation 1002, which represents a user positioning a wake shaping system (e.g., wake shaping system 102) on a starboard side of a ski boat (e.g., ski boat 106). Here, in this embodiment a user may rotate the wake shaping system via rotating an arm (e.g., arm 204) and a coupling mechanism (e.g., coupling mechanism 210) about a pylon (e.g., pylon 202) to the starboard side of the ski boat. However, in other embodiments of the wake shaping systems (e.g., wake shaping system 602, or wake shaping system 802) a user may also displace the wake shaping system along a rail mechanism (e.g., rail mechanism 604, or rail mechanism 806) to position the wake shaping system on the starboard side of the ski boat. Here, in this example process, a user has positioned the wake shaping system on the starboard side based on a regular footed wakesurfer that prefers to wakeboard facing frontside to a wake. With the wake shaping system positioned on the starboard side, a ballast (e.g., ballast 108A and 108B) removeably coupled to a second end (e.g. second end 208) of the arm is selectively positioned a distance (e.g. distance 110) above a waterline (e.g., waterline 112) and a distance (e.g., distance 114) past a gunwale (e.g., gunwale 116) of the ski boat. Operation 1002 is followed by operation 1004. Operation 1004 represents heeling the ski boat towards the starboard side. More specifically operation 1004 represents rolling the ski boat a degree (e.g., degree 902) towards the starboard side and pitching the ski boat a degree (e.g., degree 904) towards the stern. Process 1000 continues with operation 1006, where a user may navigate the ski boat heeled toward the starboard side. Operation 1006 is followed by operation 1008. Operation 1008 represents shaping a wake of the navigating ski boat heeled toward the starboard side. Here, at operation 1008, the ski boat produces an asymmetrical wake providing a starboard wake larger, than a port side wake.

While process 1000 describes positioning a wake shaping system on the starboard side of the ski boat, other positions are contemplated. For example, process 1000 may also describe positioning a wake shaping system on a port side or a stern side of the ski boat.

What is claimed is:

1. A ski boat for shaping a wake comprising:

a wake shaping system fixed to a portion of the ski boat, the wake shaping system comprising:

a pylon removeably fixed to the portion of the ski boat;

an arm having a first end and a second end, the first end of the arm being pivotably coupled to the pylon and the second end of the arm reaching a distance from the pylon and a distance above the waterline of the ski boat, the arm being configured to selectively pivot about the pylon to a port side of the ski boat and/or a starboard side of the ski boat;

a coupling mechanism for pivotably coupling the arm to the pylon, the coupling mechanism comprising:

a bearing portion comprising a pin rotateably disposed in the bearing portion, the pin extending distally from the bearing portion and fixed in an opening of the pylon; and a clamping portion juxtaposed to the bearing portion, the clamping portion being removeably clamped to another clamping portion disposed on the first end of the arm; and a ballast configured to be selectively positioned a distance above a waterline of the ski boat, and a distance past a longitudinal center line of the ski boat, wherein the ballast selectively positioned the distance above the waterline and the distance past the longitudinal center line of the ski boat heels the ski boat towards the port side of the ski boat and/or towards the starboard side of the ski boat.

2. The ski boat of claim 1 wherein, the ballast is further configured to be selectively positioned a distance past a gunwale of the ski boat.

3. The ski boat of claim 1 wherein, the heeling of the ski boat comprises rolling the ski boat, a degree, towards the starboard side and/or the port side, and pitching the ski boat, another degree, towards the stern.

4. The ski boat of claim 1 wherein, the wake shaping system is fixed to a rail mechanism disposed on a stern portion of the ski boat and arranged between the starboard side and the port side, the rail mechanism being configured to selectively position the wake shaping system substantially proximate to the starboard side and/or substantially proximate to the port side.

5. The ski boat of claim 1 wherein, the wake shaping system is pivotably coupled substantially proximate to a stern port gunwale corner and/or substantially proximate to a stern starboard gunwale corner of the ski boat, the pivotably coupled stern port gunwale corner wake shaping system being configured to selectively position the ballast to the port side and/or stern, and the pivotably coupled stern starboard gunwale corner wake shaping system being configured to selectively position the ballast to the starboard side and/or stern.

6. The ski boat of claim 1 wherein, the wake shaping system is pivotably coupled to a rope tow pylon receiver hitch disposed on the aft portion of the ski boat substantially proximate to a longitudinal center line of the ski boat, the pivotably coupled wake shaping system being configured to selectively position the ballast to the starboard side, stern, and/or to the port side of the ski boat.

7. The ski boat of claim 1 wherein, the wake shaping system is fixed to a portion of a pylon tower of the ski boat, the portion of the pylon tower being configured to selectively position the wake shaping system to the starboard side and/or the port side of the ski boat.

8. The ski boat of claim 7 wherein, the wake shaping system is fixed to a rail mechanism arranged on a top portion of the pylon tower, the rail mechanism being configured to selectively position the wake shaping system to the starboard side and/or the port side of the ski boat.

9. A wake shaping system for shaping a wake of a ski boat, the wake shaping system comprising:

a pylon removeably fixed to a portion of the ski boat;

an arm having a first end and a second end, the first end of the arm being pivotably coupled to the pylon and the second end of the arm reaching a distance from the pylon and a distance above the waterline of the ski boat, the arm being configured to selectively pivot about the pylon to a port side of the ski boat and/or a starboard side of the ski boat;

a coupling mechanism for pivotably coupling the arm to the pylori, the coupling mechanism comprising:

a bearing portion comprising a pin rotateably disposed in the bearing portion, the pin extending distally from the bearing portion and fixed in an opening of the pylon; and a clamping portion juxtaposed to the bearing portion, the clamping portion being removeably clamped to another clamping portion disposed on the first end of the arm; and a ballast removeably coupled to the second end of the arm and suspended the distance from the pylon and the distance above the waterline of the ski boat, wherein the ballast suspended the distance from the pylon and the distance above the waterline of the ski boat heels the water ski boat towards the port side of the ski boat and/or towards the starboard side of the ski boat.

10. The wake shaping system of claim 9 wherein, the heeling of the ski boat comprises rolling the ski boat, a degree, towards the starboard side and/or the port side, and pitching the ski boat, another degree, towards the stern.

11. The wake shaping system of claim 9, further comprising:

a locking mechanism arranged with the bearing portion, the locking mechanism for selectively locking the wake shaping system.

12. The wake shaping system of claim 9 wherein, the arm comprises approximately about the following dimensions:

a 72 inch length;

a 0.5 inch width; and a 18 inch overall depth.

13. The wake shaping system of claim 9 wherein, the arm is formed of aluminum, steel, carbon fiber, fiberglass, or plastic.

14. The wake shaping system of claim 9 wherein, the distance from the pylon of the ski boat comprises approximately about 76 inches.

15. The wake shaping system of claim 9 wherein, the distance above the waterline comprises approximately about 30 inches.

16. The wake shaping system of claim 9 wherein, the ballast is a bladder configured to contain up to about 5 gallons of water.

17. The wake shaping system of claim 9 wherein, the portion of the ski boat comprises an existing rope tow pylon receiver hitch of the ski boat, and the pylon is removeably fixed to the existing rope tow pylon receiver hitch of the ski boat.

18. A method of shaping a wake of a ski boat, the method comprising:

using a wake shaping system comprising;

a pylon removeably fixed to a portion of the ski boat;

an arm having a first end and a second end, the first end of the arm being pivotably coupled to the pylon and the second end of the arm reaching a distance from the pylon and a distance above the waterline of the ski boat, the arm being configured to selectively pivot about the pylon to a port side of the ski boat and/or a starboard side of the ski boat;

a coupling mechanism for pivotably coupling the arm to the pylon, the coupling mechanism comprising:

a bearing portion comprising a pin rotateably disposed in the bearing portion, the pin extending distally from the bearing portion and fixed in an opening of the pylon; and a clamping portion juxtaposed to the bearing portion, the clamping portion being removeably clamped to another clamping portion disposed on the first end of the arm; and a ballast removeably coupled to the second end of the arm and suspended the distance from the pylon and the distance above the waterline of the ski boat;

positioning the ballast on the starboard side and/or the port side of the ski boat;

heeling the ski boat via the ballast positioned on the starboard side and/or the port side of the ski boat;

navigating the heeled ski boat; and shaping an asymmetrical wake, the asymmetrical wake providing a starboard wake larger, than a port side wake and/or a port side wake larger, than a starboard side wake.

* * * * *